United States Patent [19]

Ito et al.

[11] Patent Number: 4,933,412

[45] Date of Patent: Jun. 12, 1990

[54] METHOD OF IMPARTING FLAME RESISTANCE TO POLYESTER FIBER SUBSTRATES

[75] Inventors: Etsuo Ito; Masanari Matsumura, both of Kyoto; Kazuhiko Ishihara, Shiga; Toshiaki Doyama, Kyoto, all of Japan

[73] Assignee: Dai-Ichi Kogyo Seiyaku Co., Ltd., Kyoto, Japan

[21] Appl. No.: 309,526

[22] Filed: Feb. 10, 1989

[30] Foreign Application Priority Data

Feb. 19, 1988 [JP] Japan ..... 63-37738

[51] Int. Cl.[5] ..... C08K 5/02

[52] U.S. Cl. ..... 524/466; 8/490; 524/411; 524/412; 524/467

[58] Field of Search ..... 524/411, 412, 466, 467; 8/490; 252/609; 570/186, 231, 236, 246

[56] References Cited

U.S. PATENT DOCUMENTS

| | | | |
|---|---|---|---|
| 3,093,599 | 6/1963 | Mueller Tamm et al. | 521/59 |
| 3,419,518 | 12/1968 | Mahling et al. | 524/412 |
| 3,432,461 | 3/1969 | Hill et al. | 524/180 |
| 3,544,641 | 12/1970 | Versnel | 570/246 |
| 3,558,727 | 1/1971 | Jenkner et al. | 570/246 |
| 3,833,675 | 9/1974 | Newcombe et al. | 570/246 |
| 3,849,371 | 11/1974 | Wolford et al. | 524/467 |
| 4,783,563 | 11/1988 | Taniuchi | 570/246 |
| 4,801,405 | 1/1989 | Yamada et al. | 252/609 |

*Primary Examiner*—Veronica P. Hoke

*Attorney, Agent, or Firm*—Jordan and Hamburg

[57] ABSTRACT

This invention relates to a flame retardant for synthetic fiber substrates and a method of imparting flame resistance to such substrates using the flame retardant. The flame retardant of this invention comprises 75 to 95 weight parts of a hexabromocyclododecane compound having a melting point not less than 195° C. and 25 to 5 weight parts of a hexabromocyclododecane compound having a melting point less than 160° C., which hexabromocyclododecane compounds are available on bromination of trans-trans-cis-cyclododecatriene. This flame retardant imparts excellent flame resistance to synthetic fiber substrates. Moreover, when a synthetic fiber substrate is dyed using a dye bath containing this flame retardant and a dye, the soiling of the substrate and dyeing equipment is kept at the minimum.

4 Claims, No Drawings

METHOD OF IMPARTING FLAME RESISTANCE TO POLYESTER FIBER SUBSTRATES

BACKGROUND OF THE INVENTION

This invention relates to a flame retardant composition for synthetic fiber substrates and a method of imparting flame resistance to synthetic fiber substrates using the same composition. More particularly, this invention relates to a flame retardant composition suitable for use in imparting flame resistance to polyester, cation-dyeable polyester, polyamide and other synthetic fibers, films, etc., mixtures or blends of such fibers, or composites of such fibers with cellulosic and other fibers other than synthetic fibers, particularly for use in the dye bath addition method (the process for dyeing and imparting flame resistance to a substrate concurrently) and a method of imparting flame resistance to synthetic fiber substrates using the same composition.

It is known, in the art of dip dyeing and thermosol dyeing, to disperse 1, 2, 5, 6, 9, 10-hexabromocyclododecane (hereinafter referred to as HBCD) in water and treat a substrate with the resulting bath to impart flame resistance but this technology has the drawback that the sorption of HBCD into a synthetic fiber substrate is low. Particularly in the dye bath addition system, a large residue of unsorbed HBCD gives rise to mass-like or tarry deposits on the dyeing equipment (hereinafter referred to as the dyeing vessel) etc. which present serious problems by soiling the vessel and the substrate.

Moreover, it is described in Japanese Patent Publication No. 49-24474, No. 49-24475 and No. 50-5187 that depending on the production procedure and conditions used, HBCD occurs as various stereoisomers. While these isomers vary in relative amounts and crystallinity according to different production procedures and conditions, they may be roughly classified into compounds melting at a temperature not less than 195° C. and compounds melting at a temperature below 160° C. These compounds can be produced independently according to the methods described in the above-mentioned patent literature but they occur generally as a mixture when produced by the hitherto-known production procedure. Fractionation of such various stereoisomers can be accomplished by RPC (reversed phase chromatography) or by means of a fractionating solvent having a selective solvent effect on HBCD, for example lower alcohols such as isopropyl alcohol, ethanol, methanol, methylcellosolve, ethylcellosolve, etc. and ketones such as acetone, methyl ethyl ketone, etc. or a mixture of such solvents. A particularly preferred fractionating solvent is a mixture of ethylcellosolve and methanol (weight ratio 1:1).

Though it depends on the degree of purification, the HBCD compound thus fractionated is usually not a single stereoisomer but a mixture of several different stereoisomers and such a mixture (complex) is identified as a compound having a certain melting point. The term 'melting point' is used herein to denote such a melting point.

The inventors of this invention conducted a detailed exploration into the influence of such HBCD compounds having different melting points on the dye bath addition process and obtained the following findings.

(1) The sorption of an HBCD compound having a melting point of ≧195° C. into synthetic fibers such as polyester fiber is only 30 to 50% of that of a compound having a melting point of <160° C.

(2) On the other hand, the sorption of a compound having a melting point of <160° C. into synthetic fibers is 2 to 3 times that of a compound having a melting point of ≧195° C. However, when the former is used in the dye bath addition system, the unsorbed low-melting compound tends to be left over in the dye bath or entrap the dye to form tarry deposits on the dyeing vessel or the substrate to cause a soiling problem.

(3) When an HBCD compound having a melting point of ≧195° C. is used in the dye bath addition system, the unsorbed residue, if any, of HBCD does not condense or coagulate but can be easily flushed away from the substrate and dyeing vessel by a simple procedure such as washing with water.

(4) Furthermore, the low-melting HBCD compound (particularly an HBCD compound melting at 130° C. or less) promotes the sorption of an HBCD compound having a melting point of ≧195° C., which is inherently lower in the rate of sorption into synthetic fibers, into a synthetic fiber substrate (a carrier effect).

This invention has been accomplished based on the above findings.

SUMMARY OF THE INVENTION

It is an object of this invention to provide a flame retardant composition for synthetic fiber substrates which imparts high flame resistance to substrates and, at the same time, causes a minimum of soiling to the dyeing vessel and the substrate particularly in the dye bath addition process and a method of imparting flame resistance to a substrate using the same composition.

This invention is directed to a flame retardant composition for synthetic fiber substrates which comprises 75 to 95 parts by weight of a hexabromocyclododecane compound melting at ≧195° C. and 25 to 5 parts by weight of a similar compound melting at <160° C., both available on bromination of trans-trans-cis-cyclododecatriene, and a method of imparting flame resistance to a synthetic fiber substrate using said composition.

DETAILED DESCRIPTION OF THE BEST MODE

As mentioned above, this invention is predicated on the discovery that, of various stereoisomers of HBCD, a compound melting at ≧195° C. and a compound melting at <160° C. exhibit dissimilar behaviors in terms of sorption into a synthetic fiber substrate and soiling of the dyeing vessel and substrate in the dye bath addition process and provides a flame retardant composition for synthetic fiber substrates which comprises a controlled mixture of a compound melting at ≧195° C. and a compound melting at <160° C. in specified proportions and represents improvements in terms of sorption into synthetic fibers and soiling of the dyeing vessel and substrate in the dye bath addition process.

Thus, as described above, the performance of the HBCD flame retardant is dependent upon the relative amounts of an HBCD compound melting at ≧195° C. which is low in the rate of sorption and in the risk of soiling the dyeing vessel and an HBCD compound melting at <160° C. which is high in the rate of sorption and in the risk of soiling the vessel.

The flame retardant composition of this invention comprises a controlled mixture of 75 to 95 parts by weight of an HBCD compound melting at ≧195° C.

and 25 to 5 parts by weight of an HBCD compound melting at <160° C., preferably a controlled mixture of 80 to 90 parts by weight of an HBCD compound melting at ≧195° C. and 20 to 10 parts by weight of an HBCD compound melting at <160° C. Where the proportion of said HBCD compound melting at ≧195° C. is in excess of the above range, no sufficient flame resistance is imparted to a substrate even though there is no problem in the soiling of the dyeing vessel and substrate. Conversely where the proportion of said HBCD compound melting at <160° C. is in excess of the above range, the risk of soiling the vessel and substrate is not sufficiently overcome even though there is no problem with the flame resistance of the dyed product. Particularly in the latter case, where the composition is applied to the dye bath addition process, not only the continuity of operation in the same dyeing vessel is poor but the step of removing deposits after dyeing must be frequently carried out so that the efficiency of the dyeing process as a whole is sacrificed, ultimately leading to a serious decrease in the economy of the dyeing process. Moreover, because the low-melting HBCD compound is liable to discolor on exposure to heat, it may cause a change in color of the dyed product if it occurs in a large amount, which imposes a limitation on the useful range.

In order to provide a controlled mixture of a high-melting HBCD compound (a compound having a melting point of ≧195° C.) and a low-melting HBCD compound (a compound having a melting point of <160° C.), the high-melting and low-melting compounds may be independently synthesized by the production methods described in the above-mentioned patent literature and be mixed in the necessary ratio or, alternatively, a production process selected from among the known processes for brominating trans-trans-cis-cyclododecatriene, which is conducive to the necessary mixture, may be selectively adopted.

Furthermore, it is possible to fractionate the HBCD compound produced by brominating trans-trans-cis-cyclododecatriene into a high-melting compound (a compound with a melting point of ≧195° C.) and a low-melting compound (a compound with a melting point of <160° C.) by means of a solvent having a selective solvent effect, such as lower alcohols, ketones, etc. and, then, mixing the two compounds in the necessary proportions.

To achieve a finely divided dispersion of the flame retardant composition of this invention, the above controlled mixture may be first pulverized with a dry pulverizer and, then, mixed with a suitable dispersing agent or protective colloid. However, the use of a dry pulverizer is not efficient, for the heat of shearing generated in the course of pulverizing causes an inter-adhesion or condensation of particles within the equipment. Therefore, a wet pulverizing-dispersing machine is preferably used for achieving a finely divided dispersion of the flame retardant composition of this invention. As pulverizing/dispersing auxiliaries which can be used in the pulverization/dispersion of the flame retardant composition of this invention, the dispersing agents or protective colloids in common use in the textile industry, such as those described in Japanese Patent Publication No. 53-8840 and No. 59-36032 can be employed. Thus, there may be mentioned such dispersing agents as ligninsulfonates, aromatic sulfonic acids, saturated aliphatic dicarboxylic acids substituted by long-chain alkyl groups, aromatic sulfonic acid-formaldehyde condensates, alkylphenol-ethylene oxide adducts, fatty acid-ethylene oxide adducts, aliphatic amine-ethylene oxide adducts, aliphatic alcohol-ethylene oxide adducts, substituted benzimidazoles, sulfonated fatty acid amides and so on. Among said protective colloids are polyvinyl alcohol, polyvinylpyrrolidone, acrylic or methacrylic polymers and copolymers, methylcellulose, carboxymethylcellulose, hydroxyethylcellulose, hydroxypropylcellulose, gelatin, acid casein, starch, natural gums (locust bean gum, guar gum, xanthan gum, etc.) and so on. Particularly for the purpose of improving the efficiency of pulverization and dispersion of HBCD compounds in an aqueous medium and enhancing the storage stability or shelf-life of the pulverized/dispersed product, it is preferable to use said dispersing agent and/or protective colloid.

In using the flame retardant composition of this invention as an aqueous dispersion type flame retardant, it is necessary to select suitable types and amounts of dispersing agent and/or protective colloid and this selection has an important bearing on the storage stability and dilution stability of the aqueous dispersion type flame retardant and the efficiency of pulverization in the wet pulverizing/dispersing stage.

When this invention is embodied as an aqueous dispersion type flame retardant comprising HBCD compounds, dispersing agent and/or protective colloid and water, the proportions of the respective components are 100 to 800 g/kg, preferably 300 to 700 g/kg, of HBCD compounds, 0 to 100 g/kg, preferably 1 to 80 g/kg, of dispersing agent and/or protective colloid, and the balance of water.

Such an aqueous dispersion type flame retardant can be prepared by charging a mixer having a premix stirrer with said HBCD compounds, dispersing agent and/or protective colloid and water to provide a crude dispersion, and, then, feeding this crude dispersion to a wet pulverizing/dispersing machine to provide a finely divided dispersion. In this pulverization and dispersion, either one of said dispersing agent and protective colloid or both may be added. When the pulverization and dispersion is carried out with the dispersing agent alone, the protective colloid may be added as a follow-up to the finely divided dispersion after completion of pulverization so as to impart thixotropic stability to the dispersion. Conversely, when the pulverization and dispersion is carried out with addition of the protective colloid alone, the dispersing agent may be added as a follow-up to the finely divided dispersion after completion of pulverization for improving the fluidity of the dispersion. When the pulverization and dispersion is to be carried out with the addition of both the dispersing agent and protective colloid, the levels of addition of the respective additives may be determined in consideration of the stability and fluidity of the resulting finely divided dispersion. Moreover, for improving the handling characteristic of the dispersion, the dispersing agent and/or protective colloid may be added in installments. In any event, since the dispersing agent or protective colloid so added may cause a decrease or increase in viscosity during pulverization and dispersion and, hence, a decrease in pulverizing efficiency, it is important to select a suitable method of addition of these pulverization/dispersion auxiliaries so that satisfactory pulverization/dispersion efficiency, storage stability, dilution stability and fluidity may be insured.

While the actual influence of the particle size of HBCD compounds in the finely divided dispersion prepared by the above procedure upon the treatment process for imparting flame resistance to a substrate remains to be elucidated, the particle size is preferably as small as possible in view of the ease of orientation on the surface of a synthetic fiber substrate, the density of orientation (it seems that the higher the density, the readier is the sorption of the composition), storage stability of the finely divided dispersion, and the uniformity of dispersion in use. Thus, the average particle size is preferably not more than 10 μ, more desirably not more than 5 μ, and for still better results not more than 1 to 2 μ.

Furthermore, the flame retardant composition of this invention may contain other additives. Thus, for example, inorganic auxiliary flame retardant compounds such as antimony trioxide etc., oxidation inhibitors, ultraviolet absorbers, etc. may be incorporated.

The flame retardant composition of this invention can be applied to synthetic fiber materials and products. Particularly, this invention is applicable to the flame retardation of loose fibers, yarns, woven fabrics, knitted fabrics, films, felts and the like each made from polyester, cation-dyeable polyester, polyamide or the like. While the process for flame retardation may be any hitherto-known dye bath addition process, thermosol dyeing process and coating process, the advantageous features of the flame retardant composition of this invention are best exploited in the dye bath addition process.

The following examples and comparative examples are intended to illustrate this invention in further detail and should by no means be construed as limiting the scope of the invention.

It should be understood that all parts are by weight and that % represents % by weight.

PRODUCTION AND ANALYSIS OF HBCD COMPOUNDS

A mixer-stirrer was charged with 100 parts of hexabromocyclododecane (Pyroguard SR-103, manufactured by Dai-Ichi Kogyo Seiyaku) available on bromination of trans-trans-cis-cyclododecatriene, 100 parts of ethylcellosolve and 100 parts of methanol, followed by mixing and stirring at 70° to 80° C. for 1 hour. Thereafter, the mixture was cooled to room temperature and filtered to separate a moist white powdery residue from a filtrate (a). This moist white powder (filtration residue) was fed to the mixer-stirrer together with 100 parts of methanol and the mixing and stirring was further carried out at 70°-80° C. for 1 hour. Then, the mixture was cooled to room temperature and filtered to give a residue and a filtrate (b). This moist white powdery residue was dried under reduced pressure at 50° C. to give 70.1 parts of product (this product being referred to as bone-dry product (a)). The above filtrate (a) and filtrate (b) were put in a 500 ml volumetric flask and the ethylcellosolve and m ethanol were distilled off under reduced pressure in an evaporator while the temperature was gradually increased from room temperature to 60°-80°C. The resulting brown resinous product was pulverized. This pulverized brown product was further dried under reduced pressure at 50° C. to give 29.2 parts of product (this product being referred to as bone-dry product (b)).

The bone-dry product (a) and bone-dry product (b) thus obtained were analyzed. The results of analysis by R.P.C. (reversed phase chromatography) are shown in Table 1. The melting point data are shown in Table 2.

The conditions of R.P.C. analysis and melting point determination were as follows.

(1) R.P.C. analysis

Apparatus: Shimadzu LC-4A

Column: ODS-120A (Toyo Soda), 300 mm long×4 mm dia.

Solvent for dissolution of samples: acetonitrile

Solvent for partition (eluent) and conditions:

Flow rate: 1 ml/minute

After the passage of a mixture of acetonitrile and distilled water (85:15, v/v) for 5 minutes, the eluent was passed through the column for 15 minutes, with the proportion of acetonitrile being increased gradually until the whole eluent would be acetonitrile.

(2) Determination of melting point

Apparatus: Mettler FP-61

Rate of temperature increase: 3° C./min.

TABLE 1

| R-TIME (min.) | Bone-dry product (a) (%) | Bone-dry product (b) (%) |
|---|---|---|
| 1.64 | — | 0.33 |
| 2.61 | 0.46 | 0.68 |
| 3.00 | — | 2.22 |
| 3.42 | — | 12.93 |
| 3.85 | — | 2.79 |
| 4.17 | 0.72 | 5.17 |
| 4.67 | 1.08 | 1.83 |
| 5.12 | 1.16 | 3.09 |
| 5.85 | — | 1.76 |
| 6.20 | 0.66 | 29.00 |
| 6.49 | 3.71 | 26.98 |
| 6.88 | — | 3.81 |
| 7.28 | — | 3.59 |
| 7.85 | 92.21 | 3.92 |
| 8.51 | — | 0.69 |
| 11.53 | — | 0.66 |
| 12.71 | — | 0.55 |
| Total | 100.00 | 100.00 |

TABLE 2

| | Bone-dry product (a) | Bone-dry product (b) |
|---|---|---|
| Mean melting point (n = 5) (°C.) | 201.0 | 117.5 |

As apparent from Table 2, the HBCD compounds fractionated with a lower alcohol solvent having a selective solvent effect each exhibit a single melting point. However, as apparent from Table 1, each of these HBCD compounds is not a single crystalline structure but a complex of a few different crystalline structures.

EXAMPLES 1 TO 5 AND COMPARATIVE EXAMPLES 1 TO 5

Using the two kinds of compounds having different melting points as obtained under Production and Analysis of HBCD Compounds above, finely divided dispersions were prepared by varying the proportions of these compounds as indicated in Table 3.

Specifically, these finely divided dispersions were prepared in the following manner. Thus, aqueous dispersions were prepared by varying the proportions of high-melting and low-melting HBCD compounds (A), premixing them with predetermined amounts of protective colloid (C) and water (D) for 10 to 15 minutes and feeding each mixture to a 2 l Viscomill (Igarashi Machine Industries, Ltd.) at the rate of 1 l/min. for continuous mixing and pulverizing. To exclude the factor of particle size of the dispersion, the average particle diameter was invariably controlled at 1–2 μ.

TABLE 3

| | | | Comparative Example | | | | | Example | | | | |
|---|---|---|---|---|---|---|---|---|---|---|---|---|
| | | | 1 | 2 | 3 | 4 | 5 | 1 | 2 | 3 | 4 | 5 |
| A | Proportions of HBCD compounds | Compound melting at ≧195° C. (%) | 100 | 70 | 65 | 60 | 50 | 95 | 90 | 85 | 80 | 75 |
| | | Compound melting at <160° C. (%) | 0 | 30 | 35 | 40 | 50 | 5 | 10 | 15 | 20 | 25 |
| | Level of addition (parts) | | 450 | 450 | 450 | 450 | 450 | 450 | 450 | 450 | 450 | 450 |
| C | Protective colloid | | CMC*1 | CMC | CMC | CMC | CMC | CMC | CMC | CMC | CMC | CMC |
| | Level of addition (parts) | | 5 | 5 | 5 | 5 | 5 | 5 | 5 | 5 | 5 | 5 |
| D | Water (parts) | | 545 | 545 | 545 | 545 | 545 | 545 | 545 | 545 | 545 | 545 |
| Average particle size*2 (μ) | | | 1.20 | 1.35 | 1.30 | 1.30 | 1.45 | 1.25 | 1.45 | 1.30 | 1.20 | 1.50 |

*1Carboxymethylcellulose

*2Determined with Shimadzu centrifugal particle size distribution analyzer SA-CP-II.

EXAMPLE OF USE 1

Using the finely divided dispersions prepared in Examples 1 to 5 and Comparative Examples 1 to 5, the dye bath addition process was practiced to investigate the flame resistance and color change of the treated fabric and the possible soiling of the treated fabric and dyeing vessel.

The dye bath addition process was carried out using a polyester woven fabric (260 g/m$^2$) consisting of both sides of regular polyester and a core of cation-dyeable polyester under the conditions shown in Table 4.

As to dyestuff, Kayacry Brilliant Yellow 5GL-ED (Nippon Kayaku) and Kayalon Polyester Blue T-S were used at 2% owf and 0.3% owf, respectively. As the dispersing agent, 0.5 g/l of Colorsol ACE-81 (Dai-Ichi Kogyo Seiyaku) was used. The dye bath was adjusted to pH 5 with acetic acid. As the dyeing machine, a 60 l Mini-circular testing machine (Nichihan Seisakusho; Model Cut-T-S) was used and the temperature was increased at a rate of 3° C./min. from 60° C. to 130° C., which was held for 1 hour, and, then, was decreased to 80° C.

Furthermore, to investigate the soiling of the treated fabric and dyeing vessel with the flame retardant composition, the sequence of dye-discard-rinse-dye was repeated using the same dye bath composition. The dyeing trial using a given dye bath was terminated when a soiling of the treated fabric and dyeing vessel was observed.

To investigate the amount of sorption of the flame retardant after completion of dyeing, the dyeing process described above was carried out and, then, the sorbed Br was assayed by X-ray fluorescence analysis. The results are shown in Table 4.

TABLE 4

| Finely divided dispersion (flame retardant) *1 Level of addition (% owf) | | Comparative Example 1 15 | Comparative Example 2 15 | Comparative Example 3 15 | Comparative Example 4 15 | Comparative Example 5 15 | Example 1 15 | Example 2 15 | Example 3 15 | Example 4 15 | Example 5 15 |
|---|---|---|---|---|---|---|---|---|---|---|---|
| Dye bath ratio | | 1:30 | 1:30 | 1:30 | 1:30 | 1:30 | 1:30 | 1:30 | 1:30 | 1:30 | 1:30 |
| Quantity of dye bath (l) | | 58 | 58 | 58 | 58 | 58 | 58 | 58 | 58 | 58 | 58 |
| Dyestuff (% owf) | | 2.3 | 2.3 | 2.3 | 2.3 | 2.3 | 2.3 | 2.3 | 2.3 | 2.3 | 2.3 |
| Dispersing agent (g/l) | | 0.5 | 0.5 | 0.5 | 0.5 | 0.5 | 0.5 | 0.5 | 0.5 | 0.5 | 0.5 |
| HBCD sorbed *2 (% owf) | | 1.16 | 3.61 | 3.93 | 4.18 | 4.59 | 2.60 | 2.96 | 3.22 | 3.40 | 3.53 |
| Flame resistance *3 | Char area (cm$^2$) | ≧45 | 6.3 | 5.8 | 5.1 | 4.2 | 22.5 | 13.6 | 8.2 | 7.3 | 7.0 |
| | Residual flame time (sec) | ≧10 | 0 | 0 | 0 | 0 | 2.6 | 1.2 | 0 | 0 | 0 |
| | Residual dust time (sec) | 0 | 0 | 0 | 0 | 0 | 0 | 0 | 0 | 0 | 0 |
| Number of dyeings (soiling of fabric) *4 | | ≧20 | 2 | 1 | 1 | 1 | ≧15 | ≧11 | ≧9 | ≧6 | ≧4 |
| Number of dyeings (soiling of dyeing vessel) *5 | | 20 | 2 | 1 | 1 | 1 | 15 | 11 | 9 | 6 | 4 |

*1 The proportion of HBCD is 45%.

*2 The mean value of HBCD sorbed at 5 points of the treated fabric.

*3 Determined in accordance with JIS L-1091A: flaming 3-second method.

*4, *5 The sequence of dye → discard → rinse → dye is repeated using the same dye bath composition and the serial number of dyeings at the onset of color change or soiling of treated fabric or dyeing vessel is determined.

As shown in Table 4, it was confirmed that as the proportion of the HBCD compound melting at <160° C. was increased, the sorption of HBCD was also increased and hence, the flame resistance of the treated fabric was improved. On the other hand, with regard to the number of dyeings with the same dye bath composition, it was found that an increased proportion of the HBCD compound melting at ≧195° C. resulted in a sharp improvement in the soiling of the dyeing vessel. This is an important factor in the economics of the dyeing process.

It will be apparent from the above results that since, in the flame retardant composition of this invention, the proportions of an HBCD compound melting at ≧195° C. and an HBCD compound melting at <160° C. are controlled within a fairly narrow range of 75 to 95 parts by weight of the former vs. 25 to 5 parts by weight of the latter, sufficient flame resistance and satisfactory dyeing economics are ensured.

EXAMPLES 6 TO 10 AND COMPARATIVE methods described in Example of Use 1. The results are set forth in Table 6.

TABLE 5

| | | | Comparative Example | | | Example | | | | |
|---|---|---|---|---|---|---|---|---|---|---|
| | | | 6*1 | 7 | 8 | 6 | 7 | 8 | 9 | 10 |
| A | Proportions of HBCD compounds | Compound melting at ≧195° C. (%) | 97.2 | 68.2 | 62.8 | 93.1 | 89.0 | 83.8 | 78.3 | 75.3 |
| | | Compound melting at <160° C. (%) | 2.8 | 31.6 | 37.2 | 6.9 | 11.0 | 16.2 | 21.7 | 24.7 |
| | Level of addition (parts) | | 450 | 450 | 450 | 450 | 450 | 450 | 450 | 450 |
| C | Protective colloid | | CMC*2 | CMC | CMC | CMC | CMC | CMC | CMC | CMC |
| | Level of addition (parts) | | 5 | 5 | 5 | 5 | 5 | 5 | 5 | 5 |
| D | Water (parts) | | 545 | 545 | 545 | 545 | 545 | 545 | 545 | 545 |
| Average particle size*3 (μ) | | | 1.39 | 1.21 | 1.19 | 1.40 | 1.31 | 1.21 | 1.43 | 1.19 |

*1(A) in Comparative Example 6 is the product obtained by subjecting (A) in Example 6 to repeated methanol washing and, then, drying in vacuo (80° C.).
*2 and *3 are the same as *1 and *2 in Table 3, respectively.

TABLE 6

| Finely divided dispersion (flame retardant) *1 Level of addition (% owf) | | Comparative Example 6 15 | Comparative Example 7 15 | Comparative Example 8 15 | Example 6 15 | Example 7 15 | Example 8 15 | Example 9 15 | Example 10 15 |
|---|---|---|---|---|---|---|---|---|---|
| Dye bath ratio | | 1:30 | 1:30 | 1:30 | 1:30 | 1:30 | 1:30 | 1:30 | 1:30 |
| Quantity of dye bath (l) | | 58 | 58 | 58 | 58 | 58 | 58 | 58 | 58 |
| Dyestuff (% owf) | | 2.3 | 2.3 | 2.3 | 2.3 | 2.3 | 2.3 | 2.3 | 2.3 |
| Dispersing agent (g/l) | | 0.5 | 0.5 | 0.5 | 0.5 | 0.5 | 0.5 | 0.5 | 0.5 |
| HBCD sorbed *2 (% owf) | | 2.02 | 3.72 | 3.81 | 2.83 | 3.01 | 3.28 | 3.47 | 3.51 |
| Flame resistance *3 | Char area ($cm^2$) | ≧45 | 6.5 | 6.1 | 24.3 | 13.0 | 7.6 | 6.8 | 6.8 |
| | Residual flame time (sec) | 9.1 | 0 | 0 | 2 | 0 | 0 | 0 | 0 |
| | Residual dust time (sec) | 0 | 0 | 0 | 0 | 0 | 0 | 0 | 0 |
| Number of dyeings (soiling of fabric) *4 | | ≧18 | 2 | 1 | ≧12 | ≧11 | ≧8 | ≧6 | 4 |
| Number of dyeings (soiling of dyeing vessel) *5 | | 18 | 2 | 1 | 12 | 11 | 8 | 6 | 4 |

*1, *2, *3, *4 and *5 are respectively the same as in Table 4.

EXAMPLES 6 TO 8

HBCD occurs as various stereoisomers according to which of trans-trans-trans-cyclododecatriene and trans-trans-cis-cyclododecatriene is used as the starting material or according to different production conditions such as the bromination reaction temperature, reaction solvent and catalyst. Therefore, an HBCD compound is generally synthesized as a mixture showing two or more melting points. The flame retardant composition of this invention was conceived of and accomplished by paying attention to the respective unique functional properties of HBCD compounds having different melting points and elucidating these functional properties.

Thus, for the various HBCD compounds prepared by bromination of trans-trans-cis-cyclododecatriene, the proportions (ratio) of the compound melting at ≧195° C. and that melting at <160° C. were determined using the lower alcohol solvent having a selective solvent effect on HBCD as described under Production and Analysis of HBCD Compounds above and the functional properties of these HBCD compounds were investigated.

The preparation of finely divided dispersions was carried out by the method described in Examples 1 to 5 and Comparative Examples 1 to 5. The results are set forth in Table 5.

EXAMPLE OF USE 2

The relative performance of the finely divided dispersions prepared in Examples 6 to 10 and Comparative Examples 6 to 8 was investigated by the evaluation It will be apparent from Tables 5 and 6 that, irrespective of the method used for synthesis of HBCD compounds, a flame retardant composition meeting the object of this invention can be produced by selective use of 75 to 95 parts by weight of an HBCD compound melting at ≧195° C. and 25 to 5 parts by weight of an HBCD compound melting at <160° C., preferably of 80 to 90 parts by weight of the former and 20 to 10 parts by weight of the latter.

EXAMPLES 11 TO 20 AND COMPARATIVE EXAMPLES 9 TO 17

Using the two kinds of HBCD compounds having different melting points as prepared under Production and Analysis of HBCD Compounds above in various proportions, it was investigated how the performance of the flame retardant of this invention varies with different kinds and amounts of dispersing agent and protective colloid used as pulverization/dispersion auxiliaries.

The preparation of finely divided dispersions was carried out by the method described in Examples 1 to 5 and Comparative Examples 1 to 5. Specifically, aqueous dispersions were prepared by varying the proportions of high-melting and low-melting HBCD compounds (A), shown in Tables 7-1 and 7-2, premixing them with predetermined amounts of dispersing agent (B) or protective colloid (C) and water (D) for 10 to 15 minutes and feeding the mixture to a 2-liter Viscomill (Igarashi Machine Industries) at a rate of 1 l/min. for continuous mixing and pulverizing. The average particle diameter of the dispersions was invariably controlled at 1 to 2 μ. In some experiments, for viscosity adjustment or enhanced fluidity, the protective colloid (E) or dispersing agent (F) was further added and the mixture was aftermixed for 5 to 10 minutes.

EXAMPLE OF USE 3

The relative performance of the finely divided dispersions (flame retardants) obtained in Examples 11 to 20 and Comparative Examples 9 to 17 was evaluated by the methods described in Example of Use 1. The results are set forth in Tables 8-1 and 8-2.

TABLE 7-1

| | | | Comparative Example | | | | | Example | | | | |
|---|---|---|---|---|---|---|---|---|---|---|---|---|
| | | | 9 | 10 | 11 | 12 | 13 | 11 | 12 | 13 | 14 | 15 |
| A | Proportions of HBCD Compounds | Compound melting at ≧195° C. (%) | 98 | 98 | 98 | 98 | 60 | 90 | 90 | 90 | 85 | 85 |
| | | Compound melting at <160° C. (%) | 2 | 2 | 2 | 2 | 40 | 10 | 10 | 10 | 15 | 15 |
| | Level of addition (parts) | | 450 | 450 | 450 | 450 | 450 | 450 | 450 | 450 | 450 | 450 |
| B | Dispersing agent | | Lavelin FH-L | Noigen ET-149 | Noigen ET-149 | Noigen ET-149 | Noigen ET-149 | Lavelin FH-L | Lavelin FH-L | Lavelin FH-L | Noigen ET-149 | Noigen ET-149 |
| | Level of addition (parts) | | 70 | 30 | 30 | 30 | 30 | 70 | 70 | 70 | 30 | 30 |
| C | Protective colloid | | — | — | — | Cellogen BS | — | — | — | Cellogen BS | — | — |
| | Level of addition (parts) | | — | — | — | 2.5 | — | — | — | 2.5 | — | — |
| D | Water (parts) | | 480 | 520 | 515 | 515 | 520 | 480 | 475 | 475 | 520 | 515 |
| E | Additional protective colloid | | — | — | Cellogen BS | Cellogen BS | — | — | Xanthan gum | Cellogen BS | — | Cellogen BS |
| | Level of addition (parts) | | — | — | 5.0 | 2.5 | — | — | 5.0 | 2.5 | — | 5.0 |
| F | Additional dispersing agent | | — | — | — | — | — | — | — | — | — | — |
| | Level of addition (parts) | | — | — | — | — | — | — | — | — | — | — |
| Average particle size *1 (μ) | | | 1.30 | 1.09 | 1.09 | 1.18 | 1.23 | 1.29 | 1.29 | 1.56 | 1.36 | 1.36 |

Lavelin FH-L: a tradename of Dai-Ichi Kogyo Seiyaku (naphthalenesulfonic acid-formaldehyde condensate Na salt)
Noigen ET-149: a tradename of Dai-Ichi Kogyo Seiyaku (nonionic surfactant)
Cellogen BS: a tradename of Dai-Ichi Kogyo Seiyaku (carboxymethylcellulose Na salt)
*1 is the same as *2 in Table 3.

TABLE 7-2

| | | | Comparative Example | | | | Example | | | | |
|---|---|---|---|---|---|---|---|---|---|---|---|
| | | | 14 | 15 | 16 | 17 | 16 | 17 | 18 | 19 | 20 |
| A | Proportions of HBCD compounds | Compound melting at ≧195° C. (%) | 60 | 60 | 60 | 60 | 85 | 85 | 80 | 80 | 80 |
| | | Compound melting at <160° C. (%) | 40 | 40 | 40 | 40 | 15 | 15 | 20 | 20 | 20 |
| | Level of addition (parts) | | 450 | 450 | 450 | 450 | 450 | 450 | 450 | 450 | 450 |
| B | Dispersing agent | | Noigen ET-149 | Noigen ET-149 | Sodium lignin-sulfonate | Sodium lignin-sulfonate | Noigen ET-149 | — | — | Sodium lignin-sulfonate | Sodium lignin-sulfonate |
| | Level of addition (parts) | | 30 | 30 | 30 | 30 | 30 | — | — | 30 | 30 |
| C | Protective colloid | | — | Xanthan gum | — | — | Guar gum | Cellogen BS | Cellogen BS | — | — |
| | Level of addition (parts) | | — | 2.5 | — | — | 1.0 | 5.0 | 3.0 | — | — |
| D | Water (parts) | | 515 | 515 | 520 | 515 | 515 | 515 | 530 | 520 | 510 |
| E | Additional protective colloid | | Xanthan gum | Xanthan gum | — | Guar gum | Guar gum | Noigen ET-149 | Xanthan gum | — | PVA |
| | Level of addition (parts) | | 5.0 | 2.5 | — | 5.0 | 4.0 | 30.0 | 2.0 | — | 10.0 |
| F | Additional dispersing agent | | — | — | — | — | — | — | Noigen ET-149 | — | — |
| | Level of addition (parts) | | — | — | — | — | — | — | 15.0 | — | — |
| Average particle size *1 (μ) | | | 1.09 | 1.63 | 1.78 | 1.78 | 1.53 | 1.02 | 1.31 | 1.88 | 1.88 |

*1 is the same as in Table 7-1.

TABLE 8-1

| Finely divided dispersion (flame retardant) *1 Level of addition (% owf) | | Comparative Example 11 15 | Comparative Example 12 15 | Example 12 15 | Example 13 15 | Example 15 15 |
|---|---|---|---|---|---|---|
| Dye bath ratio | | 1:30 | 1:30 | 1:30 | 1:30 | 1:30 |
| Quantity of dye bath (l) | | 58 | 58 | 58 | 58 | 58 |
| Dyestuff (% owf) | | 2.3 | 2.3 | 2.3 | 2.3 | 2.3 |
| Dispersing agent (g/l) | | 0.5 | 0.5 | 0.5 | 0.5 | 0.5 |
| HBCD sorbed *2 (% owf) | | 1.76 | 1.80 | 3.01 | 2.91 | 3.18 |
| Flame resistance *3 | Char area ($cm^2$) | ≧45 | ≧45 | 13.8 | 15.1 | 8.0 |
| | Residual flame time (sec) | 9.8 | 10.8 | 0 | 0 | 0 |
| | Residual dust time (sec) | 0 | 0 | 0 | 0 | 0 |
| Number of dyeings | | ≧20 | ≧20 | ≧12 | ≧11 | ≧10 |

TABLE 8-1-continued

| Finely divided dispersion (flame retardant) *1 Level of addition (% owf) | Comparative Example 11 15 | Comparative Example 12 15 | Example 12 15 | Example 13 15 | Example 15 15 |
|---|---|---|---|---|---|
| (soiling of fabric) *4 | | | | | |
| Number of dyeings (soiling of dyeing vessel) *5 | 20 | 20 | 12 | 11 | 10 |

*1, *2, *3, *4 and *5 are respectively the same as in Table 4.

TABLE 8-2

| Finely divided dispersion (flame retardant) *1 Level of addition (% owf) | | Comparative Example 14 15 | Comparative Example 15 15 | Comparative Example 17 15 | Example 16 15 | Example 17 15 | Example 18 15 | Example 20 15 |
|---|---|---|---|---|---|---|---|---|
| Dye bath ratio | | 1:30 | 1:30 | 1:30 | 1:30 | 1:30 | 1:30 | 1:30 |
| Quantity of dye bath (l) | | 58 | 58 | 58 | 58 | 58 | 58 | 58 |
| Dyestuff (% owf) | | 2.3 | 2.3 | 2.3 | 2.3 | 2.3 | 2.3 | 2.3 |
| Dispersing agent (g/l) | | 0.5 | 0.5 | 0.5 | 0.5 | 0.5 | 0.5 | 0.5 |
| HBCD sorbed *2 (% owf) | | 4.29 | 4.06 | 4.13 | 3.12 | 3.27 | 3.43 | 3.31 |
| Flame resistance *3 | Char area ($cm^2$) | 4.8 | 5.3 | 5.4 | 8.8 | 7.1 | 6.8 | 7.0 |
| | Residual flame time (sec) | 0 | 0 | 0 | 0 | 0 | 0 | 0 |
| | Residual dust time (sec) | 0 | 0 | 0 | 0 | 0 | 0 | 0 |
| Number of dyeings (soiling of fabric) *4 | | 1 | 1 | 1 | ≧8 | ≧10 | ≧7 | ≧5 |
| Number of dyeings (soiling of dyeing vessel) *5 | | 1 | 1 | 1 | 8 | 10 | 7 | 5 |

*1, *2, *3, *4 and *5 are respectively the same as in Table 4.

What is claimed is:

1. A method of imparting flame resistance to a polyester fiber substrate which comprises dip dyeing the substrate in a dye bath containing a flame retardant composition which comprises 75 to 95 parts by weight of a hexabromocyclododecane compound with a melting point not less than 195° C. and 25 to 5 parts by weight of a hexabromocyclododecane compound with a melting point less than 160° C., said hexabromocyclododecane compounds being available on bromination of trans-trans-cis-cyclododecatriene, and a dye.

2. The method of claim 1 wherein said flame retardant composition is previously subjected to wet pulverization/dispersion to provide a finely divided dispersion.

3. The method of claim 1 wherein said flame retardant composition further comprises at least one pulverization/dispersion auxiliary agent.

4. The method of claim 1 wherein the temperature of the dye bath does not exceed about 130° C.

* * * * *